US005094219A

United States Patent [19]

Koshida et al.

[11] Patent Number: 5,094,219

[45] Date of Patent: Mar. 10, 1992

[54] DISTRIBUTOR WITH IGNITION COIL

[75] Inventors: Ryoichi Koshida; Hiromitsu Nagae; Nariyoshi Kobayashi, all of Katsuta, Japan

[73] Assignee: Hitachi, Ltd., Tokyo, Japan

[21] Appl. No.: 609,659

[22] Filed: Nov. 6, 1990

[30] Foreign Application Priority Data

Nov. 15, 1989 [JP] Japan ..... 1-295046

[51] Int. Cl.[5] ..... F02P 7/02

[52] U.S. Cl. ..... 123/635; 123/146.50 A

[58] Field of Search ..... 123/634, 635, 146.5 A

[56] References Cited

U.S. PATENT DOCUMENTS 2,782,247 2/1957 Bales ..... 123/634
3,638,630 2/1972 Hetzler et al. ..... 123/635
4,129,107 12/1978 Boyer ..... 123/146.5 A

FOREIGN PATENT DOCUMENTS 78176 6/1980 Japan .
104162 8/1981 Japan .
183475 11/1986 Japan .

*Primary Examiner*—Tony M. Argenbright
*Attorney, Agent, or Firm*—Antonelli, Terry, Stout & Kraus

[57] ABSTRACT

A distributor comprising a rotor electrode, a plurality of distributor electrodes, a housing supporting movably the rotor electrode, an ignition coil which supplies the electric current of high voltage to the rotor electrode, and an ignition coil supporter which is fixed to the housing and on which the ignition coil is mounted so that the ignition coil is accommodated by the distributor, wherein the natural frequency of the ignition coil supporter is greater than the explosion frequency of the combustion engine and a thermoplastic characteristic of the ignition coil seupporter is less than that of a plastic resin cap covering a spark clearance between the rotor electrode and each of the distributor electrodes.

11 Claims, 5 Drawing Sheets

DISTRIBUTOR WITH IGNITION COIL

BACKGROUND OF THE INVENTION AND RELATED ART STATEMENT

The present invention relates to a distributor for an internal combustion engine, and more particularly, to a distributor having a cap receiving an ignition coil.

The distributor on which the ignition coil is mounted to simplify outer electric wires, to make an assembly thereof easy and to decrease a space receiving the distributor and ignition coil in an engine compartment is disclosed in Publications of U.S. Pat. No. 4,129,107, Japanese Patent Unexamined Publication No. 55-78176, Japanese Patent Unexamined Publication No. 56-104162 and Japanese Utility Model Unexamined Publication No. 61-183475.

In the conventional distributors as above described, a central electrode sliding on a central electrically conductive member of a rotor electrode is worn by vibration of the central electrode during an operation of the internal combustion engine so that a life span of the central electrode is short. And the cap receiving the ignition coil vibrates substantially especially when temperature in the engine compartment is high.

OBJECT AND SUMMARY OF THE INVENTION

An object of the present invention is to provide a distributor accomodating an ignition coil, in which distributor elements thereof do not vibrate in relation to a main body of the distributor.

Another object of the present invention is to provide a distributor accomodating an ignition coil, which distributor can be used in a high-temperature environment.

According to the present invention, the ignition coil is supported by a member whose natural frequency is greater than an explosion frequency of the combustion engine. A thermal elasticity characteristic of the member supporting the ignition coil may be less than a thermal elasticity characteristic of a cap surrounding a rotor electrode and a central electrode so that a stiffness of the member supporting the ignition coil is greater than a stiffness of the cap in the high-temperature circumstance. A thermal expansion characteristic of the member supporting the ignition coil may be less than a thermal expansion characteristic of the cap.

In the distributor according to the present invention, since the natural frequency of the member supporting the ignition coil is greater than the explosion frequency of the combustion engine, a contacting end of the central electrode is not moved radially on the rotor electrode by the vibration of the ignition coil, so that the contacting end of the central electrode is prevented from being worn partially. Further, when the thermal expansion characteristic of the member supporting the ignition coil is less than the thermal expansion characteristic of the cap surrounding the rotor electrode and the central electrode, the ignition coil is supported securely in the high-temperature environment.

DETAILED DESCRIPTION OF PREFERRED EMBODIMENTS

Figure 1:
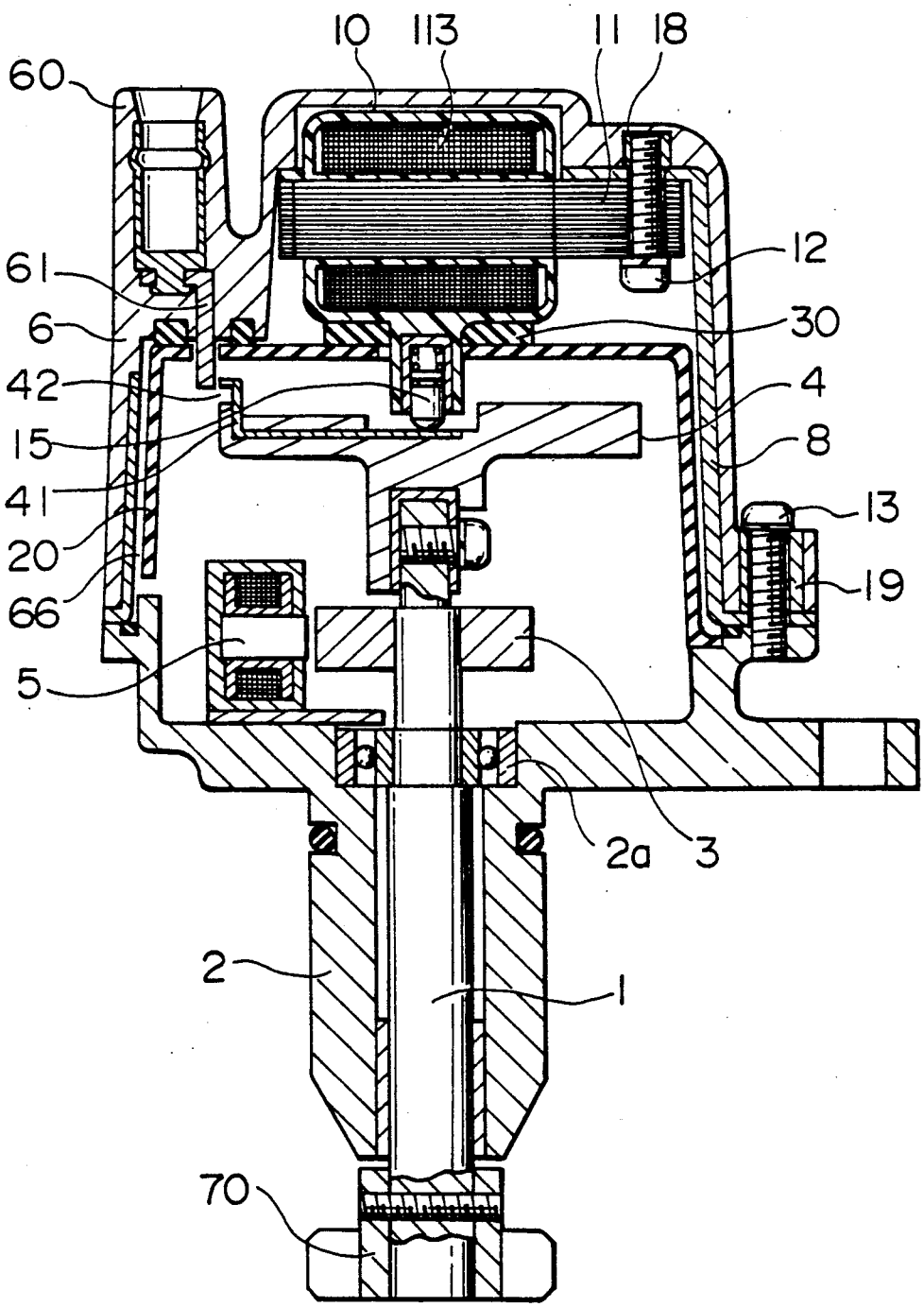
FIG. 1 is a cross sectional view showing an embodiment of the distributor according to the present invention.

In FIG. 1, a shaft 1 is rotatable on a housing 2 by a bearing 2*a*. A signal rotor 3 and a distributor rotor 4 is mounted on the shaft 1 to rotate with the shaft 1. A pick-up coil 5 and a distributor cap 6 of a plastic resin are mounted on the cap 20. A metal plate 8 and bushes 18 and 19 are embodied integrally in the cap 6. An iron core 11 of an ignition coil 10 is fixed to the metal plate 8 by bolts 12. An insulating cover 20 is arranged between the ignition coil 10 and the distributor rotor 4. A packing 30 is arranged between the insulating cover 20 and the cap 6 and between the insulating cover 20 and the ignition coil 10 and is pressed fixedly against by bolts 13.

The shaft 1 rotates synchronously with a rotation of an engine (not shown). The pick-up coil 5 outputs signals showing rotational positions of a crank shaft of the engine in accordance rotational movement of the signal rotor 3, and the output signals are transferred to a control device (not shown). High voltage is generated at the ignition coil 10 in response to ignition timing signals generated by the control device. The high voltage is supplied to a radially forward exposed end of a rotor electrode 41 on the distributor rotor 4 through a central electrode 15 and an exposed conductive portion arranged at a center of the rotor electrode 41 which is mounted on the distributor rotor 4 and with which the central electrode 15 contacts. The high voltage generates sparks at air gaps 42 between the rotor electrode 41 and cap-side electrodes 61 facing to the rotor electrode 41 so that the high voltage is distributed to each of ignition plugs of combustion cylinders through high voltage terminals 60. A number of the electrodes 61 is identical with a number of the combustion cylinders and circumferential distances between the electrodes 61 adjacent to each other is identical with each other.

Heat energy generated by a core loss and copper loss of a coil 113 of the ignition coil 10 is transmitted to the housing 2 by a iron core 11 and the metal plate 8. The ignition coil 10 is fixed to the metal housing 8 by bolts 12 which pass through the ignition coil 10 and are screwed into respective bushes 18 of the cap 6. The metal plate 8 is fixed to the housing 2 so that the ignition coil 10 is fixed to the housing 2. A thickness and shape of the metal plate 8 is sufficient for maintaining the natural frequency of the cap 6 more than 200 Hz when the ignition coil is mounted on the metal plate 8 and the metal plate 8 is fixed to the housing 2.

Figure 6:
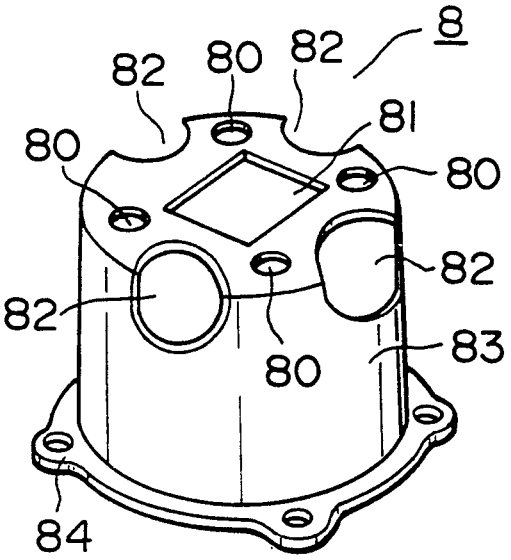

In this embodiment, a cup-shaped metal plate shown in FIG. 6 is embedded in a plastic mold resin and has a thickness of 1.3 mm. Therefore, the natural frequency of the metal plate 8 is about 350 Hz when the ignition coil is mounted on the metal plate 8 and the metal plate 8 is fixed to the housing 2.

The natural frequency of the metal plate 8 is changed by an elasticity of a packing 30, an elasticity of an insulating cover 20 and a force pressing the cap 20 and the insulating cover 20. Therefore, the natural frequency of the metal plate 8 is estimated or measured in consideration of these degrees.

The natural frequency is measured by detecting a frequency of the maximum amplitude at an outer surface of the cap 20 when a vibrator vibrates the distributor assembly at various frequencies. In case of this embodiment, the amplitude of the outer surface of the cap 20 is 0.5 mm at 350 Hz of the vibration frequency, and the amplitude thereof is less than 0.1 mm at the other vibration frequencies. When the distributor assembly is heated to 200 degrees C. in a heat cycle test, an amount of deformation of the cap 20 is one fifth in comparison with an amount of deformation of a conventional cap which is not assembled with the metal plate. In the heat cycle test, a circumstance of the distributor assembly is maintained at various temperatures between −40 degrees C. and 200 degrees C., and each of the various temperatures is maintained for a five hour time period.

In the embodiments of the present invention, an outer shape of the distributor is substantially cylindrical. Since the ignition coil is arranged between the high-voltage terminals, the ignition coil is incorporated efficiently in the distributor. If a magnetizing electric current is large for decreasing a number of turns of the coil with maintaining a desired output current, a heat generated by the coil can be cooled by a heat conduction of the metal plate. A thickness of the metal plate is selected in consideration of vibration frequencies applied to the distributor during actual operation thereof.

When an air gap 66 is formed between the insulating cover 20 and the cap 6, the inside of the insulating cover 20 is not cooled rapidly so that a dew condensation causing a spark miss in the distributor is prevented even if an outer surface of the distributor is cooled rapidly by, for example, water.

Figure 7:
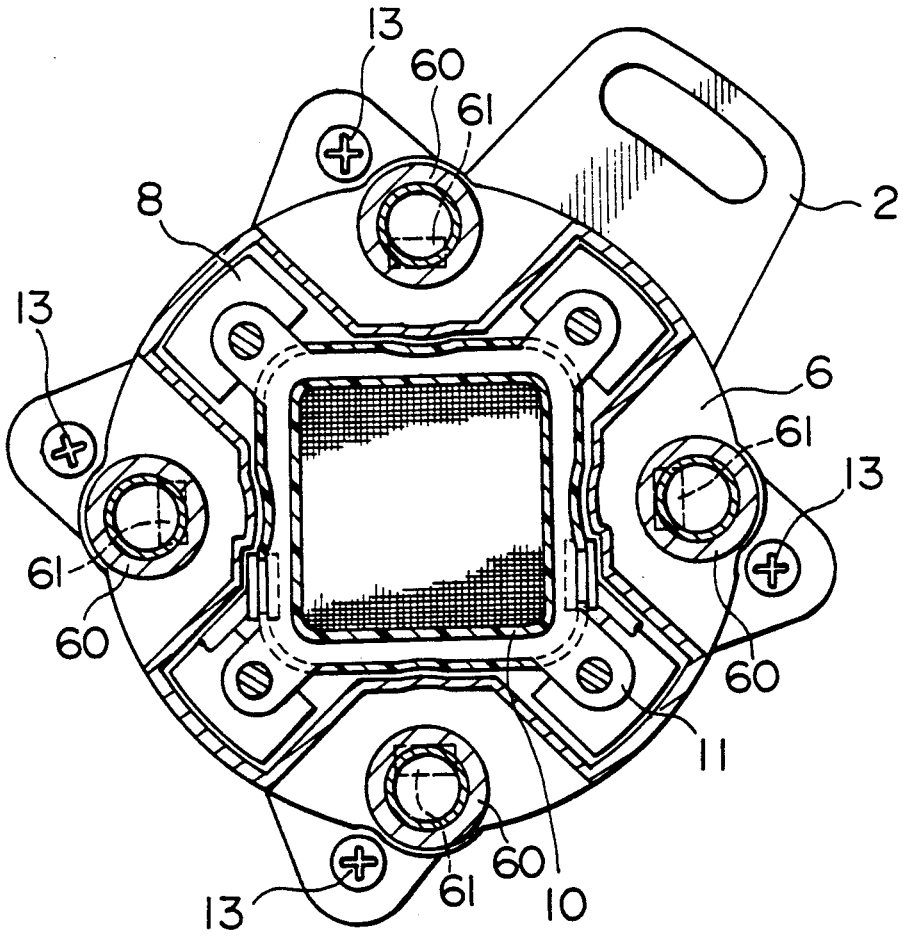
FIG. 7 is a cross sectional view taken along a line VII—VII in FIG. 2.

When angular ranges in which portions of the metal plate 8 extending substantially parallel to a rotational axis of the shaft 1 exist are different from angular ranges in which sparks is generated between the rotor electrode 41 and the cap-side electrodes 61, as shown in FIG. 7, electrical resistance between the earthed metal plate 8 and the energized rotor electrode 41 is increased even if a radial distance between the metal plate 8 and the rotor electrode 41 is small.

When the metal plate 8 has a cup shape for surrounding the spark ranges between the rotor electrode 41 and the cap-side electrodes 61, the earthed metal plate 8 prevents spark noise from flowing out of the distributor. In this case, as shown in FIG. 6, the metal plate 8 has a central hole 81 for receiving the coil, through holes 80 surrounding the central hole 81 for fixing the coil and high-voltage terminal holes 82. A portion 84 of the metal plate 8 extends from a support leg portion 83 to fix the metal plate 8 to the housing by bolts which pass holes arranged on the portion 84.

Figure 4:
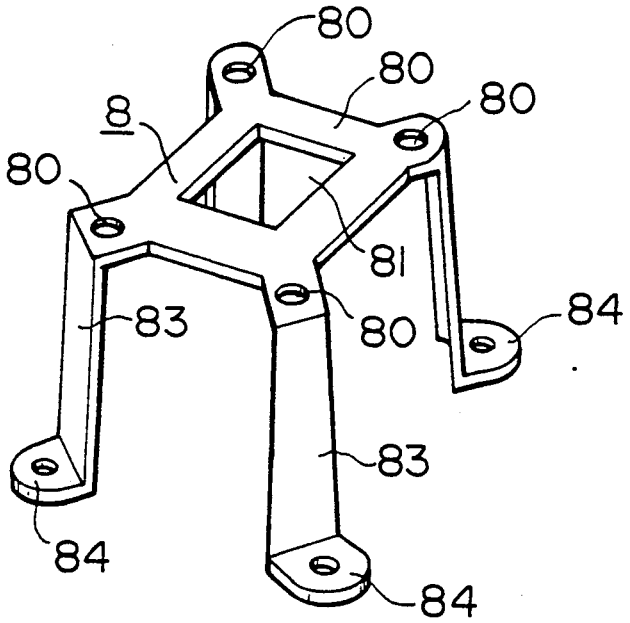
FIGS. 4 to 6 are oblique projection views showing an ignition coil supporting member according to the present invention.
Figure 5:
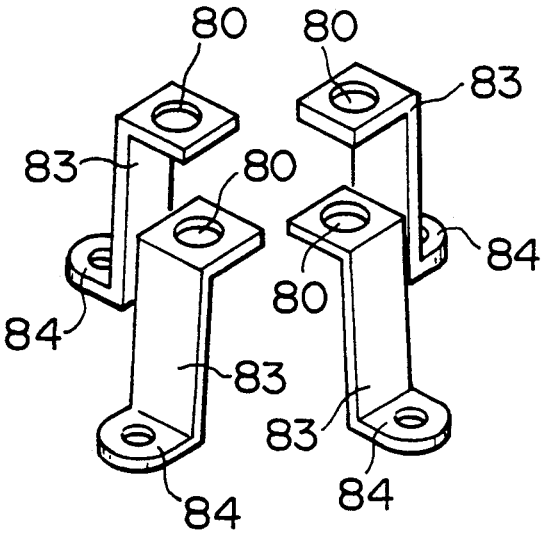

When the spark noise is absorbed by another member, the support leg portion 83 of the metal plate 8 may be slender legs with cut off portions therebetween, as shown in FIG. 4. The support leg portion 83 may be divided to four legs, as shown in FIG. 5. In FIG. 1, the central electrode 15 is connected directly to the ignition coil. The central electrode 15 and the ignition coil may be separately fixed to the insulating cover 20 and may be connected to each other by electric wires. A spring 15*a* presses the central electrode 15 against the rotor electrode 41. The packing 30 has an annular shape to surround the electrode 15. The other packings 30 have annular shapes to surround the side electrodes 61.

The insulating cover 20 has a central electrode hole and side electrode holes whose number is identical with a number of the side electrodes 61. The insulating cover 20 prevents electric current from flowing from the rotor electrode 41 to the metal plate 8.

The ignition coil 10 may be independent from the cap 6, and the ignition coil 10 mounted on the metal plate 8 may be integrally embedded in the cap 6 together with the high-voltage terminals.

Figure 2:
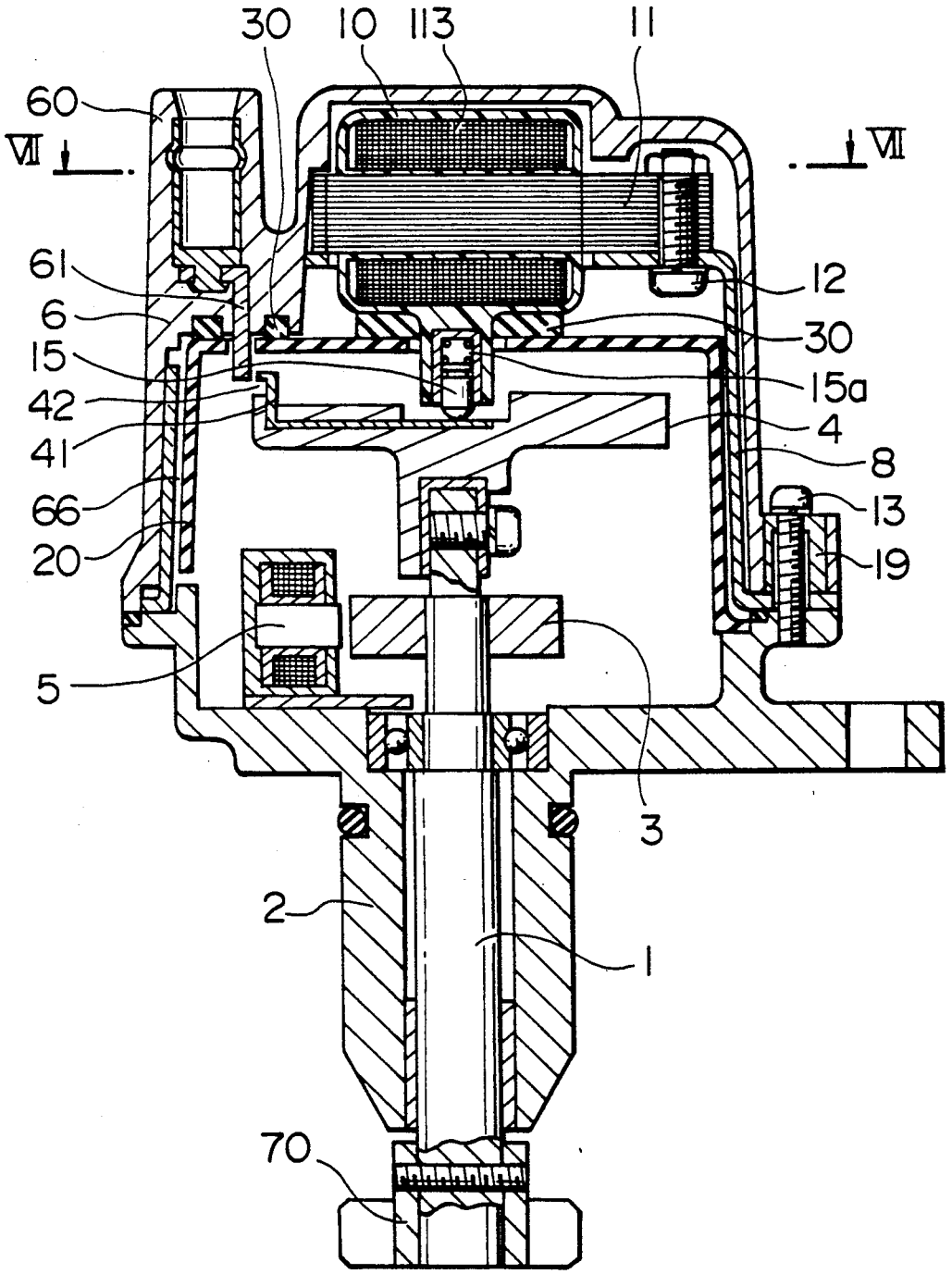
FIGS. 2 and 3 are cross sectional views showing the other embodiment of the distributor according to the present invention.

In FIG. 2, the plastic resin cap 6 is separate from the metal plate 8 with a clearance therebetween, and the ignition coil 10 is fixed to the metal plate 8 by bolts 12. Since a weight of the ignition coil 10 is supported only by the metal plate 8, the natural frequency of the cap 5 may be less than 200 Hz. The deformation of the cap 6 by the increase in temperature or by the vibration is limited within the clearance by the metal plate 8 so that the contact between the rotor electrode 41 and the cap-side electrodes 61 is prevented. Since the ignition coil 10 is mounted on an upper surface of the metal plate 8, the weight of the coil 10 is supported by a large part of the upper surface so that the coil 10 is fixed securely to the metal plate 8.

Figure 3:
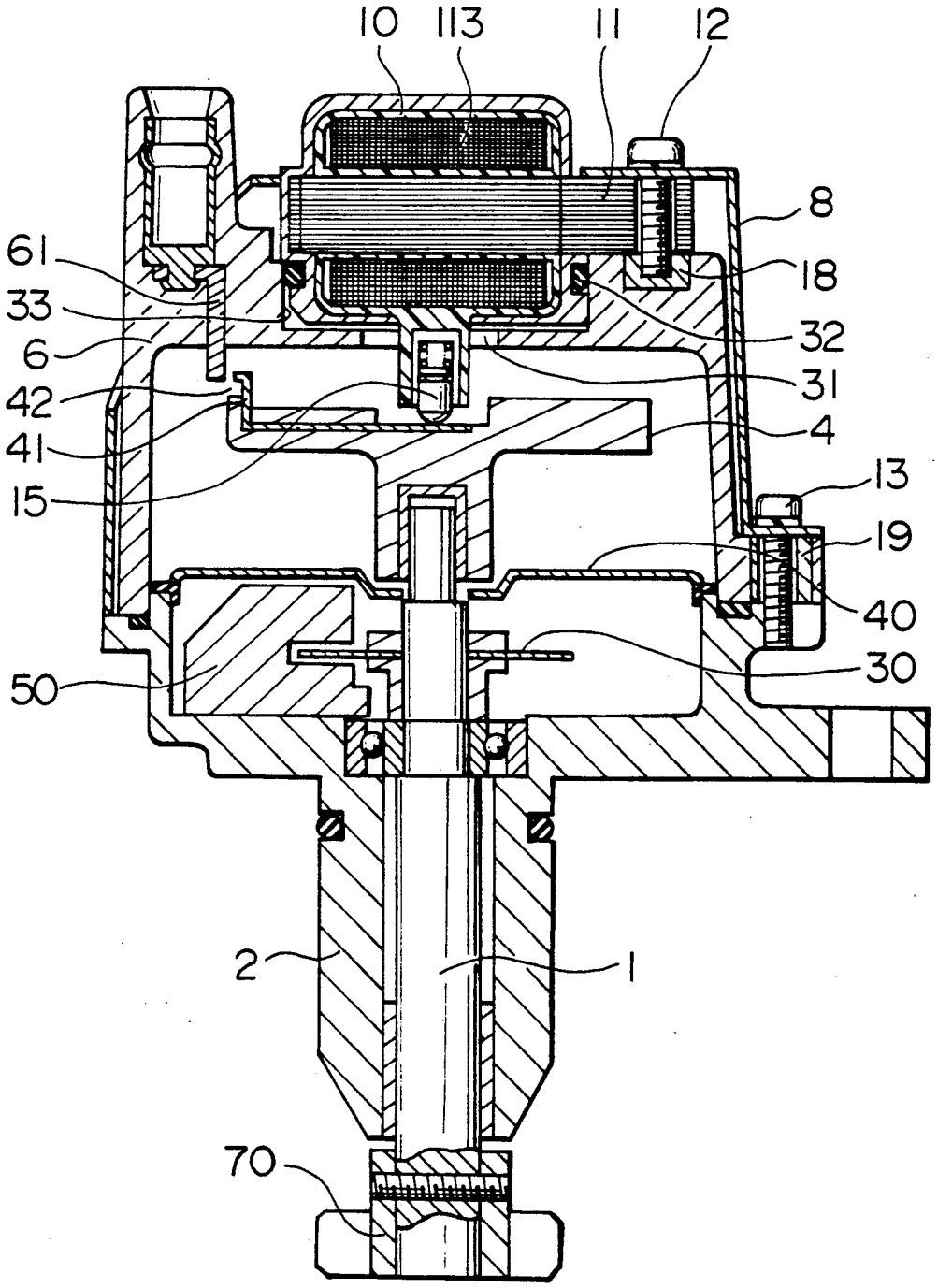

In FIG. 3, the metal plate 8 surrounds the outer surface of the plastic resin cap 6. A hole 31 for receiving the central electrode 15 is arranged on an upper and central region of the plastic resin cap 6, and a recess 33 for receiving the ignition coil 10 is arranged above the hole 31 and arround it. A packing 32 is arranged between a periphery of a resin portion of the ignition coil 10 and the recess 33 to form a sealing therebetween. The iron core 11 of the ignition coil 10 is held on the upper end surface of the resin cap 6 by the bolts 12 which pass through holes formed in the core 11 and is screwed into bushes 18 embedded in the resin cap 6. A well known photosensor 50 detects slits extending radially on a rotational disk 30 to measure angular positions of the crank shaft. A dust cover 40 prevents dust from contacting with the rotational disk 30. And the metal plate 8 is effective for protecting the insulating cover 20 or the plastic resin cap 6. The metal plate 8 may be fixed to the plastic resin cap 6 in a welding manner, or an adhering manner or tightly fitting manner.

In the embodiments according to the present invention, the ignition coil 10 is arranged closely adjacent to the cap 6 and at a substantially central portion of the distributor electrodes 61 arranged circumferentially. Therefore, the outer shape of the distributor is substantially cylindrical and the shaft 1 need not be elongated. Since the ignition coil 10 is fixed to the housing 2 through the metal plate 8, the heat generated by the ignition coil 10 is transmitted efficiently to the housing 2 and a compactness, heat resistance, and anti-vibration characteristic of the distributor are remarkably improved.

The metal plate is made of iron, stainless steel, aluminum, aluminum alloy or brass. The insulating cover 20 is made of plastic resin, ceramic, or bakelite.

What is claimed is:

1. A distributor comprising:

a plurality of stationary electrodes each having a surface, the surfaces of the respective stationary electrodes being arranged along a circular line and connected to a combustion chamber of a combustion engine, a rotor electrode having a surface movable along the circular line to distribute electric current through a spark clearance from the rotor electrode to each of the stationary electrodes in accordance with a movement of the rotor electrode in relation to the stationary electrodes, a housing movably supporting the rotor electrode, an ignition coil for supplying a high voltage electric current to the rotor electrode, and an ignition coil supporter fixed to the housing and having the ignition coil mounted thereon so that the ignition coil is accommodated by the distributor, wherein a natural frequency of the ignition coil supporter is greater than an explosion frequency of the combustion engine.

2. A distributor according to claim 1, wherein the natural frequency of the ignition coil supporter is not less than 200 Hz.

3. A distributor comprising:

a shaft adapted to rotate synchronously with a rotation of a combustion engine, a distributor rotor mounted on the shaft, rotor electrode means mounted on the distributor rotor and including a central exposed portion and a radially outer exposed end, the radially outer exposed end moving along a circumferential line in accordance with a rotation of the rotor, the central exposed portion and the radially outer exposed end is connected electrically, a plurality of distributor electrodes arranged along the circumferential line to face the radially outer exposed end moving along the circumferential line with a spark clearance therebetween, circumferential distances between the adjacent distributor electrodes being constant along the circumferential line, a plastic resin cap covering the spark clearance, a housing for rotatably supporting the shaft and having the plastic resin cap fixed thereto, an ignition coil including a central electrode contacting the central exposed portion, a coil connected to the central electrode to supply a high voltage electric current, and an iron core magnetized by the coil to convert an input low voltage electric current to a high voltage electric current, and a thermal plastic ignition coil supporting means fixed in relation to the housing and supporting the ignition coil so that the ignition coil is accommodated by the distributor, wherein a thermoplastic characteristic of the ignition coil supporting means is less than that of the plastic resin cap so that deformation of the ignition coil supporting means is less than that of the plastic resin cap at a high temperature.

4. A distributor according to claim 3, further comprising a metal plate which extends to closely contact an inner surface of the cap, one end of the metal plate being fixed to the housing together with the cap and the iron core being fixed to another end of the metal plate to retain the ignition coil.

5. A distributor according to claim 3, wherein the ignition coil supporting means has portions extending substantially parallel to a rotational axis of the shaft, and wherein angular ranges where the portions are arranged differ from angular ranges where the distributor electrodes are arranged.

6. An ignition coil support member used in a distributor, comprising:

a first end for mounting an ignition coil, a second end adapted to be fixed to a housing of the distributor, and an intermediate portion extending between the first end and the second end and adapted to extend along a surface of a distributor cap covering the distributor.

7. A distributor comprising:

a shaft adapted to rotate synchronously with a rotation of a combustion engine, a distributor rotor mounted on the shaft to rotate with the shaft, rotor electrode means mounted on the distributor rotor, a plurality of distributor electrodes arranged on a circumferential line to face the rotor electrode means, circumferential distances between adjacent distributor electrodes being constant along the circumferential line, a distributor cap covering a spark clearance between the rotor electrode means and the distributor electrodes, a housing for rotatably supporting the shaft and having a plastic resin cap fixed thereto, an ignition coil generating high voltage synchronously with the rotation of the combustion engine, and a metal member fixed in relation to the housing and extending closely along a side wall of the distributor cap wherein the ignition coil is arranged at a center of the circumferential line and fixed to the metal member.

8. A distributor according to claim 7, wherein the metal member is embedded integrally in the distributor cap made of a plastic resin.

9. A distributor according to claim 7, wherein the metal member is fixed to the housing together with the distributor cap by bolts fixing the distributor cap to the housing.

10. A distributor according to claim 7, wherein the metal member has a cup-shape covering substantially all of an outer surface of the distributor cap.

11. A distributor according to claim 7, wherein the metal member is arranged inside of the distributor cap, and an insulating cover is arranged inside of the metal member.

* * * * *